United States Patent [19]

Sommer

[11] 4,154,680

[45] May 15, 1979

[54] CLEANING IMPLEMENT FOR SWIMMING POOLS

[75] Inventor: Peter Sommer, Schinznach-Dorf, Switzerland

[73] Assignee: Sommer, Schenk AG., Switzerland

[21] Appl. No.: 810,385

[22] Filed: Jun. 27, 1977

[30] Foreign Application Priority Data

Jun. 28, 1976 [CH] Switzerland ..... 8257/76
Mar. 9, 1977 [CH] Switzerland ..... 2957/77

[51] Int. Cl.[2] ..... E04H 3/20; B01D 35/02

[52] U.S. Cl. ..... 210/169; 15/1.7; 210/242 R

[58] Field of Search ..... 210/169, 241, 242 R, 210/413; 15/1.7

[56] References Cited

U.S. PATENT DOCUMENTS

| | | | |
|---|---|---|---|
| 1,510,863 | 10/1924 | Rose | 210/413 |
| 2,923,954 | 2/1960 | Babcock | 15/1.7 |
| 3,402,817 | 9/1968 | Dovel | 210/242 R |
| 3,950,809 | 4/1976 | Schatzmann | 15/1.7 |
| 3,972,339 | 8/1976 | Henkin et al. | 210/169 X |
| 4,040,864 | 8/1977 | Steeves | 210/169 X |

*Primary Examiner*—John Adee

*Attorney, Agent, or Firm*—Roylance, Abrams, Berdo & Farley

[57] ABSTRACT

An apparatus or implement for underwater cleaning of swimming pool bottoms and/or walls having a chassis with traction drive and a suction pump mounted on the chassis. A suction nozzle is connected to the suction side of the pump, for drawing in settled particles. A filter is connected to the pressure side of the pump for catching the particles. A controlled diving cell which is floodable and clearable in a controlled manner is arranged on the chassis for varying the buoyancy of the apparatus sufficiently to raise and lower it in the water. A brush with a particular bristle configuration may be mounted in the suction nozzle.

17 Claims, 7 Drawing Figures

CLEANING IMPLEMENT FOR SWIMMING POOLS

This invention relates to an apparatus or implement for underwater cleaning of swimming pool bottoms and/or walls.

BACKGROUND OF THE INVENTION

Cleaning implements for underwater cleaning of swimming pools are presently known. In a first known type, the implement is developed as a transport chassis. Mounted on the chassis is an electrically driven pump having a suction nozzle on its suction side for drawing in the settled dirt and a filter on its pressure side for catching the drawn in dirt. The implement is lowered to the basin bottom on a pole and moved by this pole back and forth over the basin bottom. In a further known type, the transport chassis features a traction drive with a sensor. A direction change results when the sensor contacts the basin wall. The remainder of this implement includes a electrically driven suction pump, suction nozzle, and filter as in the first-named type.

The disadvantage of these known cleaning elements is that they may be lowered into the basin and taken out again only with considerable difficulty because of their comparatively high weight. For this reason, the known cleaning implements are equipped with additional equipment, such as for example transporting and submerging carts, launching ramp, skids, lift crane, or the like, in order to assure a lowering and removal of the cleaning implement with minimal effort and without damaging the basin rims.

BRIEF DESCRIPTION OF THE INVENTION

An object of the present invention is to provide an apparatus or implement for underwater cleaning of swimming pool bottoms and/or walls which may be lowered into and removed from the pool easily without any assisting equipment.

Another object of the present invention is to provide an improved brush construction for a suction nozzle.

Briefly described, the invention includes an apparatus for underwater cleaning of swimming pool bottoms and/or walls, comprising a chassis with a traction drive means for moving the chassis, a first suction pump mounted on the chassis, a suction nozzle coupled to the suction side of the first suction pump for drawing in settled particles on the pool walls or bottom, a filter connected to the pressure side of the first pump for catching the particles, at least one controlled diving cell mounted on the chassis, and means coupled to the cell for flooding and clearing the cell in a controlled manner to enable the chassis to be selectively raised and lowered in the water easily without any assisting equipment.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification.

DESCRIPTION OF THE PREFERRED EMBODIMENT

Figure 1:
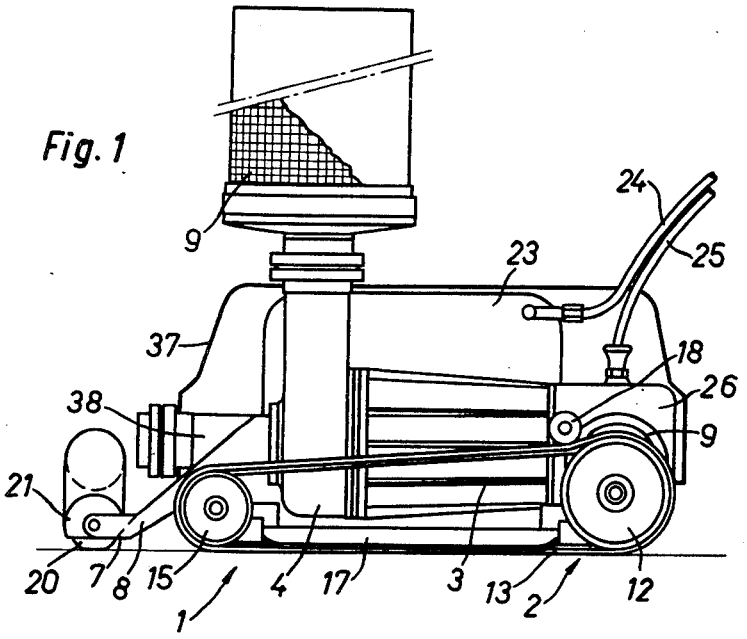
FIG. 1 shows a partially sectioned side view of a cleaning implement for cleaning swimming pools in accordance with the present invention.
Figure 2:
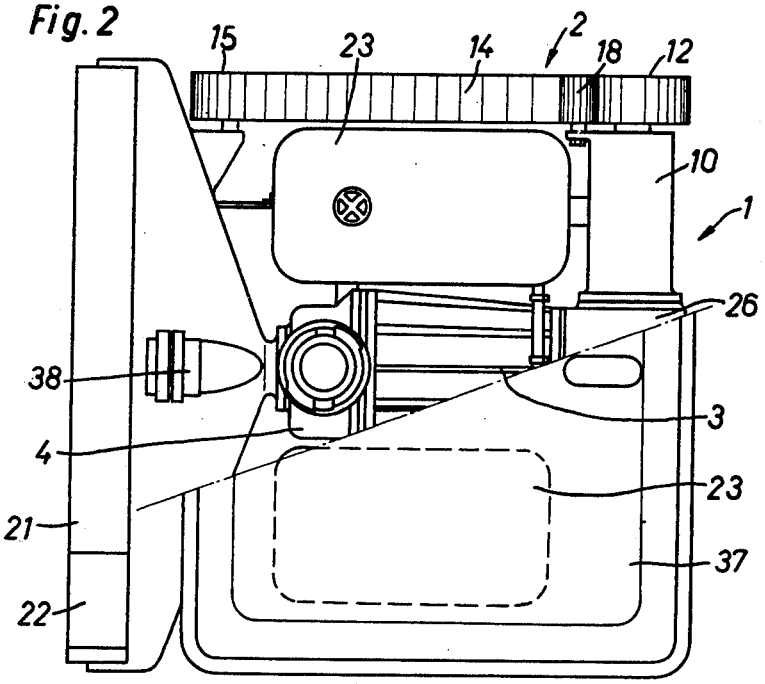
FIG. 2 shows a top view of the cleaning implement of FIG. 1 with the cover partially broken away.

The cleaning apparatus or implement of FIGS. 1 and 2 features a traction chassis 1 having an endless belt traction drive assembly and housing an electric motor 3. Two centrifical pumps 5, 6 are mounted with flanges on the electric motor 3 and driven by it. The first suction pump 5 has on its suction side a suction nozzle 8 with a narrow suction slit 7 at its mouth, and has on its pressure side a filter 9 in which the dirt drown in side a filter 9 in which the dirt drawn in through the suction nozzle 8 is caught.

The endless belt traction drive assembly 2 has two regulatable electric motors 10, 11 which each drive a drive wheel 12 of one of the endless belts 13, 14. The endless belts 13, 14 each run over a guide roller 15 and are supported by a support beam 17. A tension roller 18 is provided for each of the endless belts 13, 14 permits tensioning thereof.

The suction nozzle 8 has a housing 21 directly in front of the suction slit 7. The housing 21 is open toward the bottom and has a rotating brush roller 20 therein. The rotating brush roller 20 is driven by a hydraulic motor 22 housed over the housing 21 and powered by the second pump 6.

On both sides of the motor 3, which has an axis of rotation arranged parallel to the direction of movement of the traction chassis 1, diving cells 23 are mounted on chassis 1. These cells 23 may be filled or cleared with the help of the second pump 6. In accordance with FIG. 1, an air base 24 is attached to the driving cells 23 which reaches from the submerged implement up, beyond the water surface. An electric power cable 25 for the electric motors 3, 10 and 11 runs next to the air hose 24 and terminates in a terminal housing 26, in which the connections for the motors are found. It is also possible to locate the supply cable 25 inside the air hose 24, so that air hose 24 acts as a protective casing for the cable 25.

Figure 3:
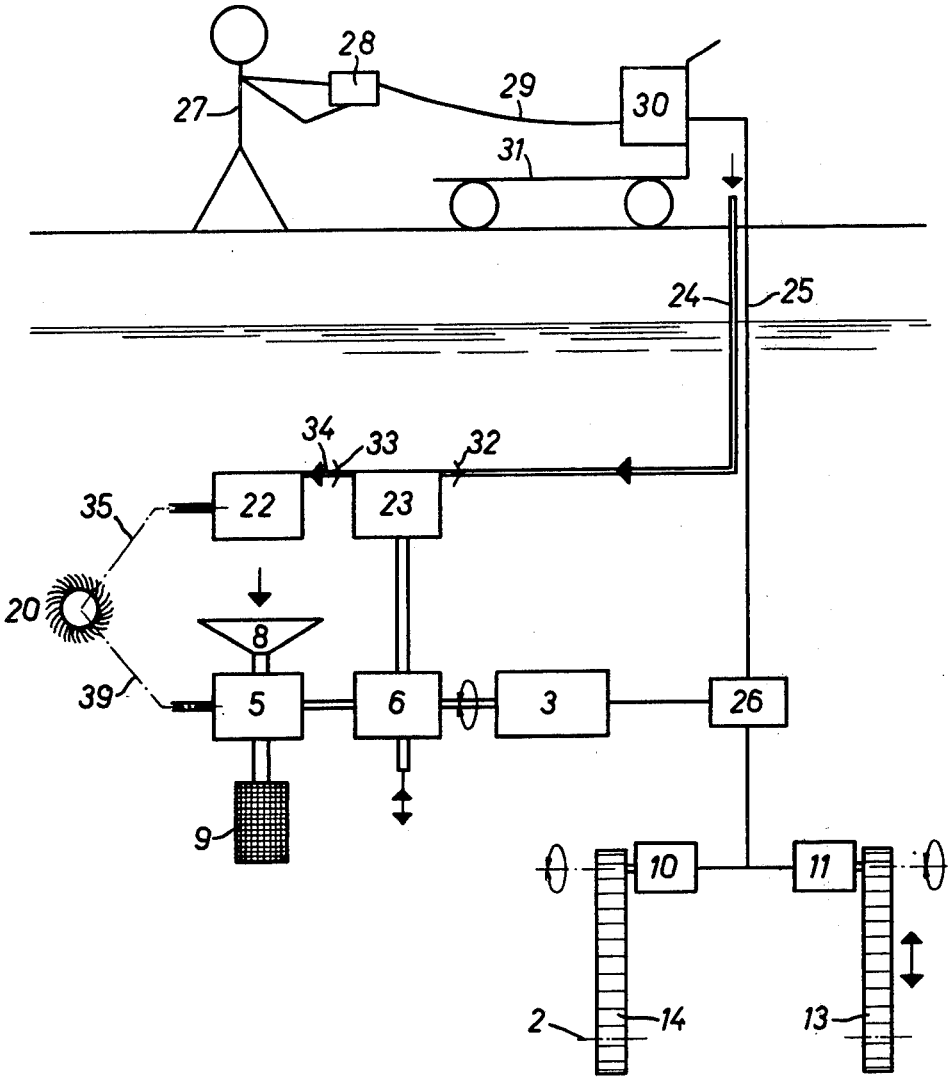
FIG. 3 shows a circuit diagram of the cleaning implement of FIG. 1.

In FIG. 3, the circuit diagram of the cleaning implement, is illustrated together with the schematic operating arrangement for it. The reference numerals used in FIGS. 1 and 2 are also used as reference numerals for the corresponding parts in FIG. 3.

An operator 27 actuates the manual control implement 28, which is connected to a control box 30 by a connecting cable 29. The control box 30 is arranged on a vehicle 31 which is movable along the pool as the cleaning operation proceeds.

The pump 6 is driven in opposite directions for flooding and clearing the diving cell 23. In a first direction above rotation, of pump 6 water is fed into the diving cell 23 and the air thereby expelled through the vent cable 24. In the line 24 there is a biased stop check valve 32. The valve 32 remains open for expulsion of the air, but closes after complete flooding of the diving cell 23. After closing of valve 32, further pumping of the pump 6 is directed to the hydraulic motor 22 through another line 34 containing another check valve 33. Motor 22 sets the brush roller 20 in motion through the mechanical connection 35 to stir up the particles settled in the basin.

During the flooding of the diving cell 23, the pump 6 runs in the same rotational direction as that in which the pump 5 draws in the dirt loosened by the brush 20 through the nozzle 8 and delivers it to the filter 9. This is also the rotational direction for submerging the cleaning implement when it is floating at the water surface with a cleared diving cell 23. With progressive flooding of the diving cell 23, the cleaning implement slowly submerges and can then immediately again cleaning the pool bottom.

For clearing the diving cell 23 to raise the cleaning implement to the water surface, the pump 6 rotates in the opposite direction and draws the water out of the diving cell 23.

The cleaning implement can be moved by remote control over the pool bottom with the manual control implement 28. The motors 10, 11 make straight forward and backward movements with matched rotational frequencies and make curves with differing rotation frequencies. A change of direcction in the same place results with opposing rotational directions.

In the utilization of the cleaning implement, it is driven into the water and floats at the surface. After the motors 3 are switched to the rotational direction "flood", the diving cells 23 become flooded and the cleaning implement sinks to the pool bottom. The cleaning may begin with immediate adjustment of its progress. When the cleaning is finished or the filter 9 requires cleaning, a switching of the motor 3 to the rotational direction "clear" causes the diving cells 23 to fill with air and the cleaning implement to rise to the surface.

In FIGS. 1 and 2, a cover is shown in the form of a bell which extends over the entire traction chassis 1. The cover 37 may also be used as a diving bell. For this, a flooding valve in the top surface of the cover 37 is opened for flooding. For rising, compressed air is delivered underneath the cover 37.

Non-controlled diving cells may be provided in addition to the controlled diving cells 23 to assist in the attainment of a stable position of the cleaning implement.

The diving cell 23 can be divided into gas and liquid spaces by an elastic membrane or by gas-filled displacement bodies with variable volume which are charged with pressure for the duration of the diving phase. Air or water can also by supplied to the displacement bodies from outside.

Finally, the diving cells 23 can also have elastic, extensible wall material and can be supplied with compressed air from outside.

In FIGS. 1 and 2, a support tube 38 is disposed over the suction nozzle 8. The pump 5 may draw in particles through the suction nozzle 8 or through the support 38 as desired. The attachment of a hose with suction nozzle to the support 38 permits this arrangement to be used for drawing in settled dirt from the side walls of the pool.

In FIG. 3, there is also shown the possibility of directly connecting the brush roller 20 to the shaft of the pump 5 of the motor 3 by a mechanical power train 39.

In FIGS. 4–7, a cleaning implement is shown with a simplified, but nevertheless very effective suction nozzle.

Figure 4:
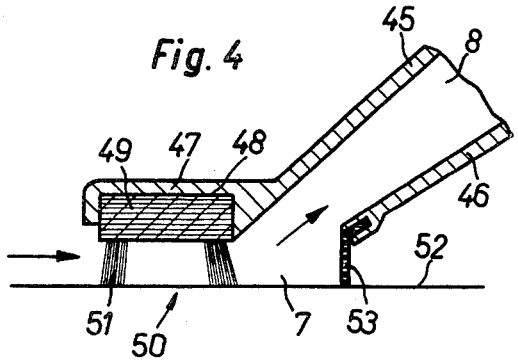
FIG. 4 shows a cross-section of the suction slit of a suction nozzle with a modified brush.

In FIG. 4, the part surrounding the suction slit 7 of the suction nozzle is shown. The arrows indicate the direction of the fluid current.

The suction nozzle 8 has an upper cover 45, which together with the lower cover 46, forms the suction slit and passes into a flat colar 47. The collar 47 forms a downward-facing cavity in which the back 49 of a brush 50 is fastened with the bristles 51 pressing against the pool bottom 52. The bottom 52 and the brush back 49 form a cleaning slot lying in front of the suction slit 7. The back side of the suction slit 7 is closed off from the exterior by a back wall 53.

Figure 5:
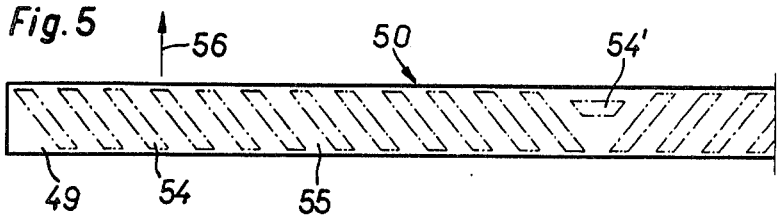
FIG. 5 shows a top view of the brush arranged in front of the suction slit of FIG. 4.

As illustrated in FIG. 5, the brush 50 has a long, narrow brush back 49. Parts 54 on the underside of the brush back 49 with bristles 51 are indicated by the broken line borders. The bristled parts 54 are in the shape of individual bristle rows separated by bristle-free parts 55. The bristle parts 54 are sloped relative to the direction of the operation of the suction nozzle, shown by an arrow 56, so that there is no direct free path between any two bristled parts 54. The bristle parts 54 are sloped in opposite directions on opposite sides of the middle of the brush 50. In the middle, there is a bristled part 54' arranged perpendicular to the operating direction 56. The longitudinal dimension of the brush 50 is suited to the length of the suction slit 7.

Figure 6:
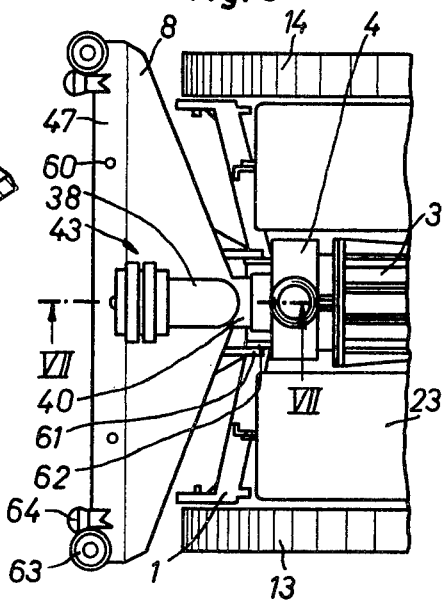
FIG. 6 shows a top partial view of a cleaning implement with a suction nozzle and a suction slit in accordance with FIGS. 4 and 5.
Figure 7:
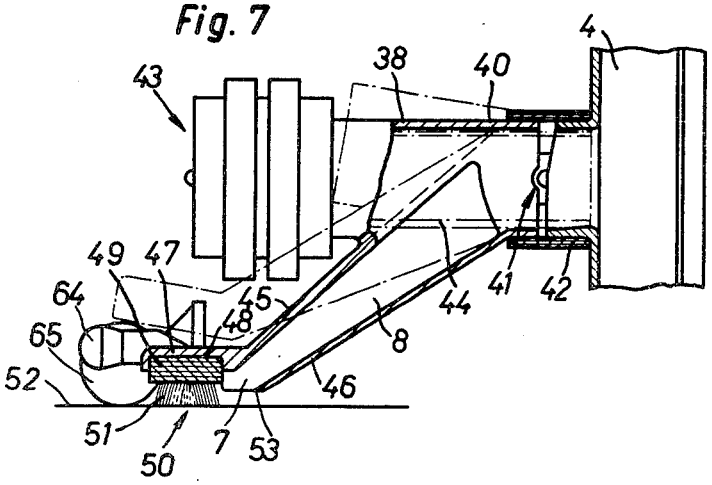
FIG. 7 shows the slit illustrated in FIG. 6 in enlarged form and along the line VII—VII.

The mounting of the suction nozzle 8 in accordance with FIGS. 4 and 5 is illustrated in the partly shown cleaning implement of FIGS. 6 and 7. The elements of FIGS. 4–7 which are similar to those of FIGS. 1 and 2 are noted with the same reference numerals and are not described further.

the suction nozzle 8 is locked to the pump housing 4 through a pipe fitting 40. As shown in FIG. 7, the pipe fitting 40 is made jointed with a pivot joint 41 having a horizontal pivot axis. The pivot joint 41 is sealed pressure-tight by an elastic jacket 42. The pipe fitting 38 is closable by a pipe coupling 43. In order to make use of this connection, the opening to the suction nozzle 8 must be closed off, as for example by the pipe insert 44, shown in broken lines. Pipe insert 44 may be screwed into the pipe fitting 38 with the pipe coupling 43 open. For normal cleaning, however, the pipe insert 44 is removed and the pipe coupling 43 closed. The extreme positions of the suction nozzle 8 and the pipe fitting 38 are shown by the broken lines in FIG. 7. Fastening holes 60 (FIG. 6) for fastening the brush 50 are provided in the collar 47. The suction nozzle 8 is provided with swing arms 61 which are pivotally connected to each other by tongues 62 on the traction chassis 1. The swing axis of the swing arms 61 and tongues 62 is aligned with that of the pivot joint 41.

FIGS. 6 and 7 also show bumpers in the form of rollers 63 with a vertical rotational axis and bumper studs 64.

The suction nozzle 8 also has support means, such as the adjustable height rollers or skids 65 at the two ends of the suction slit 7.

With the suction nozzle of FIGS. 4–7, particles adhering to the bottom 52 can be loosened by the brush 50 and drawn into the suction nozzle 8. The brush 50 has bristle-free parts 55 in the form of through-current canals for this purpose. In the brush 50, a relatively high current exists, which adjusts itself to the height of the bristles 51. As a result of this, the static pressure in the region of the bristles 51 is lessened, so that the water pressure pushing on the collar 47 forcefully pushes the brush 50 against the bottom 52, thereby strengthening the cleaning effect. Part of the pressure of the water on the collar 47 is, of course, on the supports 65 to partly take the load off the bristles 51.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for underwater cleaning of swimming pool bottoms and/or walls, comprising a chassis with traction drive means for moving said chassis;

a first suction pump mounted on said chassis, said first pump having a suction side and a pressure side;

a suction nozzle coupled to said suction side of said first pump for drawing in settled particles on the pool walls or bottom;

a filter connected to said pressure side of said first pump for catching the particles;

at least one controlled diving cell mounted on said chassis; and means coupled to said cell for flooding and clearing said cell in a controlled manner, whereby said chassis may be selectively raised and lowered in the water easily without any assisting equipment.

2. An apparatus according to claim 1, further comprising at least one uncontrolled diving cell mounted on said chassis.

3. An apparatus according to claim 1, wherein said means comprises a second pump coupled to said cell for flooding and clearing said cell, said second pump having a drive shaft coupled to said first pump.

4. An apparatus according to claim 3, wherein said suction nozzle has a suction slit and a rotatable brush roller mounted in said suction nozzle adjacent said slit; a hydraulic motor is mounted on said suction nozzle; said second pump having means to drive hydraulic motor and said hydraulic motor having means to rotate said brush roller.

5. An apparatus according to claim 1, wherein said cell is in the form of a bell which is open at its bottom.

6. An apparatus according to claim 1, wherein said drive means comprises a controlled endless belt traction drive.

7. An apparatus according to claim 1, wherein an air vent hose is connected to said cell, said hose having a stop check valve therein.

8. An apparatus according to claim 1, wherein said cell is arranged sidewise with its major axis oriented parallel to the direction of motion of said traction drive means.

9. An apparatus according to claim 1, wherein said suction nozzle has a suction slit, and a brush mounted on said suction nozzle adjacent to and in front of said slit and arranged along the length of said slit; said brush having interleaved bristled parts and bristle-free parts.

10. An apparatus according to claim 9, wherein said bristled parts are arranged in a row, are sloped so that adjacent bristled parts overlap in a direction perpendicular to the length of said slit, and are interspaced with said bristle-free to form through-current canals between said bristled parts.

11. An apparatus according to claim 9, wherein said suction nozzle has a front wall, said brush being fastened to said front wall with a flattened collar.

12. An apparatus according to claim 1, wherein said suction nozzle has a suction slit and support means on each end of said slit.

13. An apparatus according to claim 12, wherein said support means comprise adjustable rollers.

14. An apparatus according to claim 12, wherein said support means comprise adjustable skids.

15. An apparatus according to claim 1, wherein said suction nozzle is coupled to said first pump by a pivot joint, said pivot joint being enclosed by an elastic jacket.

16. An apparatus according to claim 1, wherein said suction nozzle has a suction slit and a pipe coupling arranged bove said slit; said pipe coupling having means adapted to be inserted into said suction nozzle for closing said slit.

17. An apparatus according to claim 1, wherein said suction nozzle has a suction slit and bumper means mounted over each end of said slit.

* * * * *